US006050415A

United States Patent [19]

Lind et al.

[11] Patent Number: 6,050,415

[45] **Date of Patent: *Apr. 18, 2000**

[54] PACKAGING

[75] Inventors: Robert Lind, Helsinki; Ulla Uimonen, Salo; Hanna Sonne, Rauma; Juhani Laiho, Salo; Jarmo Nummela, Turku, all of Finland

[73] Assignee: Nokia Mobile Phones Ltd, Espoo, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 09/136,572

[22] Filed: Aug. 19, 1998

[30] Foreign Application Priority Data

Aug. 28, 1997 [FI] Finland ..... 973537

[51] Int. Cl.[7] ..... B65D 75/56

[52] U.S. Cl. ..... 206/462; 206/470; 206/806; 229/243

[58] Field of Search ..... 206/461, 462–471, 206/775–778, 806, 807; 229/207, 243

[56] References Cited

U.S. PATENT DOCUMENTS

| | | | |
|---|---|---|---|
| 3,217,867 | 11/1965 | Harris | 206/468 |
| 3,246,747 | 4/1966 | Blish | 206/462 |
| 3,303,930 | 2/1967 | Hyland | 206/462 |
| 3,467,248 | 9/1969 | Makowicki | 206/462 |
| 4,261,462 | 4/1981 | Wysocki | 206/463 |
| 4,804,984 | 2/1989 | Heuer et al. | 206/461 |
| 4,842,141 | 6/1989 | Segal | 206/462 |

FOREIGN PATENT DOCUMENTS

| | | | |
|---|---|---|---|
| 2460858 | 3/1981 | France | 206/463 |
| 2 608 030 | 6/1988 | France . | |
| DE4336996 | 5/1995 | Germany . | |
| WO 97/05038 | 2/1997 | WIPO . | |

*Primary Examiner*—Paul T. Sewell
*Assistant Examiner*—Luan K. Bui
*Attorney, Agent, or Firm*—Perman & Green, LLP

[57] ABSTRACT

Packaging for an article or set of articles is provided by a back cardboard sheet (1*b*) and a front cardboard sheet (1*a*) sandwiched together. The front cardboard sheet (1*a*) has a central opening (4) provided therein and is attached to the back sheet (1*b*) about peripheral regions of the front sheet (1*a*). The front sheet (1*a*) remains unattached to the back sheet (1*b*) in the region surrounding the opening (4). A moulded plastics member (7) has a peripheral edge region (8) held between the unattached regions of the front and back sheets (1*a*,1*b*) and has a central portion (10) which projects through the opening (4) in the front sheet (1*a*) and which provides a housing for the article(s) to be packaged. A pair of perforated seams (5*a*,5*b*) extend from opposed edge regions of the front sheet (1*a*) to the central opening (4). By bending the cardboard sheets (1*a*,1*b*) about a seam (6) provided across the back sheet (1*b*), the perforated seams (5*a*,5*b*) can be broken to enable the plastics insert (7) to be slid out of the opening (4). The top (8*c*) of the peripheral edge region (8) of the plastics insert (7) has an aperture provided therethrough. This aperture (13) is aligned with apertures (3*a*,3*b*) in the front and back sheets (1*a*,1*b*) to allow the packaging to be hung from a display rack.

11 Claims, 3 Drawing Sheets

PACKAGING

FIELD OF THE INVENTION

The present invention relates to packaging and more particularly to tamper-proof packaging which makes it readily apparent when the packaging has previously been opened.

BACKGROUND OF THE INVENTION

A common form of packaging for an article comprises a semi-rigid cardboard sheet sandwiched between two sheets of transparent plastics. The plastics sheets overlap the edges of the cardboard sheet and are provided at their overlapping regions with a number of moulded deformations which allow the two plastics sheets to be snap-fitted together about the cardboard sheet. The front plastics sheet is moulded to allow the article to be packaged to be contained between that front plastics sheet and the cardboard sheet. This type of packaging is often known as "bubble" packaging. Advantages of bubble packaging are that designs and text can be printed on the front of the cardboard sheet whilst the article remains visible through the front plastics sheet. By providing a hole through the top of the packaging, the packaged article can be easily mounted on a display rack.

A further advantage of bubble packaging is that, even after an article has been released by separating the two plastics sheets, the article can be easily re-packaged. However, this advantage can turn out to be a considerable disadvantage. It is known for unscrupulous traders to recycle used bubble packaging to sell fake articles. The use of legitimate packaging lends considerable authenticity to the fake articles.

Another commonly used form of packaging consists of a moulded transparent plastics sheet glued around its peripheral edge regions to a backing cardboard sheet. In contrast to bubble packaging, it is readily apparent whether or not such packaging has been opened as removal of the plastics sheet will tend to tear away some of the underlying cardboard. Unlike bubble packaging however, this type of packaging cannot be reused by a purchaser for a legitimate purpose, e.g. to safely re-store a purchased article. An aperture is often provided through an upper region of the backing sheet to allow the package to be hung on a display rack. However, even when the end of the rack is locked, it is not difficult to illegally remove the package by pulling the package and tearing the cardboard.

W097/05038 describes a package in which a moulded plastics box is held by a peripheral flange region between two glued together cardboard sheets. These sheets are provided with a fold line, and a pair of perforated seams which extend from the fold line to respective edges of the box. By bending the sheets about the fold line, the perforated seams can be broken and the box released. Whilst this design provides for relatively easy opening, it suffers from the same problem as the package described in the preceding paragraph, i.e. an aperture is provided through the cardboard and the package can be removed from a display rack by tearing the cardboard.

SUMMARY OF THE INVENTION

It is an object of the present invention to overcome or at least mitigate disadvantages of known packaging. It is a further object of the present invention to provide packaging which can be hung on a display rack but which cannot be easily removed therefrom when the rack is locked.

According to a first aspect of the present invention there is provided packaging for an article or set of articles, the packaging comprising:

a back sheet;

a front sheet having an opening in a central region thereof and being attached to the back sheet at peripheral regions of the front sheet, the front sheet being unattached to the back sheet at least in the region surrounding said opening;

a plastics member having a substantially flat peripheral edge region held between the unattached regions of the front and back sheets surrounding said opening, and a central portion projecting through said opening, wherein the article(s) to be packaged can be contained between the back sheet and said central portion of the plastics member; and respective aligned apertures in the back sheet, the front sheet, and said peripheral edge region of the plastics member, whereby the packaging can be hung from a display rack by inserting the rack through the apertures.

It will be appreciated that because a display rack will pass through the plastics member, as well as through the front and back sheets, it will be difficult to tear the packaging from the rack. In the event that the end of the rack is locked, e.g. with a padlock, theft of the packaging is substantially prevented.

Preferably, said front and back sheets are semi-rigid, e.g. stiff cardboard. The front and back sheets may be provided by first and second separate sheets in which case the two sheets are attached together at said peripheral region of the front sheet by a suitable adhesive. Where the sheets are substantially rectangular and of similar sizes, adhesive may be applied in the region of two opposed edges or in the region of three or four edges.

Alternatively, the front and back sheets may be provided by a single sheet folded in the middle in which case, for substantially rectangular sheets, adhesive may be applied along only the edge region opposed to the folded edge, or additionally along one or both of the other edge regions.

Preferably, the packaging comprises at least two breakable seams extending across said unattached regions, which seams can be broken by bending the front and back sheets in the region of the seams to enable the plastics member to be removed. The opening in the front sheet may be substantially rectangular. More preferably, the periphery of the plastics member is also rectangular enabling the plastics member to be slid out from between the front and back sheets once the breakable seams have been broken.

Preferably, a seam is provided across the back sheet, the seam providing an axis about which the front and back sheets may be bent to break the breakable seams.

This seam in the back sheet may be, for example, a cut which extends part-way through the back sheet. More preferably, the breakable seams extend from the seam in the back sheet, at an angle thereto, inwardly to the opening in the front sheet. Where the front and back sheets are generally rectangular, the seam in the back sheet preferably extends transversely across the back sheet.

Preferably, the breakable seams are located substantially in a central region of the front sheet, this central region being defined between two straight lines which extend co-linearly with the longitudinally extending edges of the central projecting portion of the plastics member. The breakable seams, once broken, define a pair of flaps between the seams and said two straight lines which must be bent back to enable removal of the plastics member. More preferably, said breakable seams are provided at a side region of the packaging opposed to the side region at which said apertures are provided.

The breakable seams may each comprise an additional leg which extends from an outer edge of the front sheet, co-linear with the seam in the back sheet.

Preferably, said breakable seams are provided by perforations in the front sheet.

According to a second aspect of the present invention there is provided packaging for an article or set of articles, the packaging comprising:

a back sheet;

a front sheet having an opening in a central region thereof and being attached to the back sheet at peripheral regions of the front sheet, the front sheet being unattached to the back sheet at least in the region surrounding said opening;

a plastics member having a substantially flat peripheral edge region held between the unattached regions of the front and back sheets surrounding said opening, and a central portion projecting through said opening, wherein the article(s) to be packaged can be contained between the back sheet and said central portion of the plastics member; and at least two breakable seams extending across said unattached regions, which seams can be broken by bending the front and back sheets in the region of the seams to enable the plastics member to be removed by sliding the plastics member in a longitudinal direction, the breakable seams lying substantially within the transverse extent of the central portion of the plastics member.

Preferably, the breakable seams, once broken, define a pair of flaps which must be bent back to enable removal of the plastics member.

Preferably, the opening in the front sheet is substantially rectangular and said peripheral edge region of the plastics member is also rectangular.

Preferably, the packaging comprises a seam extending across the back sheet, the seam defining an axis about which the front and back sheets may be bent to break the breakable seams.

Preferably, the breakable seams extend from the seam in the back sheet, at an angle thereto, inwardly to the opening in the front sheet. More preferably, the front and back sheets are generally rectangular, the seam in the back sheet extending transversely across the back sheet. A further pair of breakable seams extend from respective outer edges of the front sheet, substantially co-linearly with the seam in the back sheet, to respective ones of the first mentioned breakable seams.

Preferably, said breakable seams are provided by perforations in the front sheet.

BRIEF DESCRIPTION OF THE DRAWINGS

For a better understanding of the present invention and in order to show how the same may be carried into effect reference will now be made, by way of example, to the accompanying drawings, in which.

DETAILED DESCRIPTION

Figure 1:
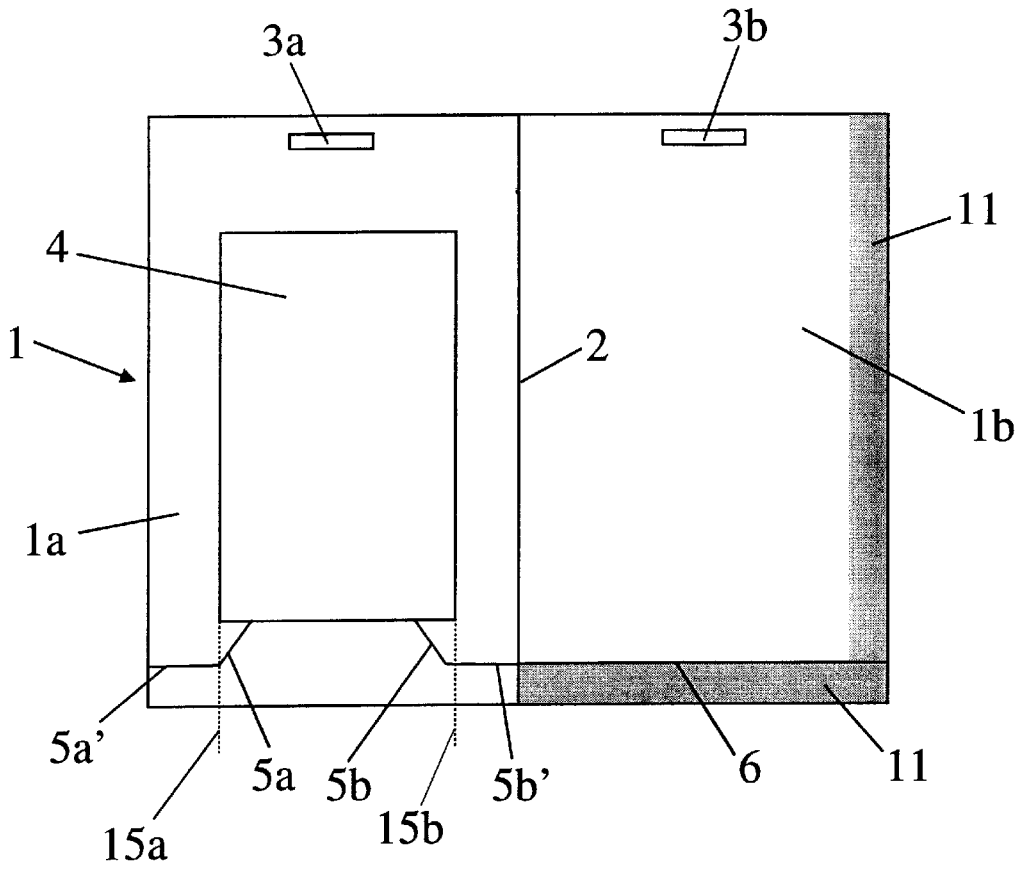
FIG. 1 shows a cardboard sheet, cut to provide front and back sheets of a package.
Figure 2:
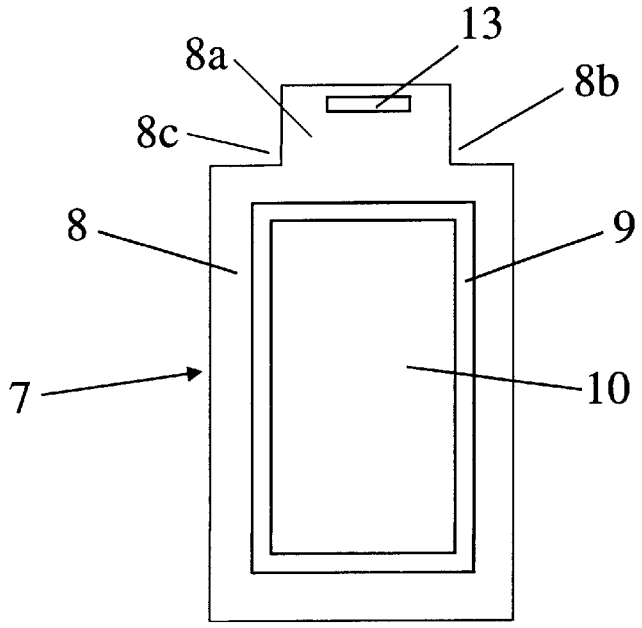
FIG. 2 shows a front view of a plastics insert of a package.

A package according to an embodiment of the present invention is assembled from the two components shown in FIGS. 1 and 2 respectively. A rectangular cardboard sheet 1 is bisected by a seam 2 which cuts or scores part-way into the cardboard, for example one third of the cardboard thickness, to enable the cardboard to be neatly folded about the seam so that the left hand side of the sheet (as viewed in FIG. 1) provides a front sheet 1*a* whilst the right hand side provides a back sheet 1*b*. Rectangular shaped apertures 3*a*, 3*b* are provided at identical locations near the top of both the front and back sheets 1*a*, 1*b*. In addition, a rectangular cut-out window or opening 4 is provided in a central region of the front sheet 1*a*.

A pair of perforated seams 5*a*, 5*b* in the shape of a 'dog-leg' extend from opposed edges of the front sheet 1*a* to respective lower edges of the opening 4. Each of these seams 5*a*, 5*b* has a lower portion 5*a*', 5*b*' which extends transversely across the front sheet 1*a* and an upper portion 5*a*", 5*b*" which extends at an angle, to the opening 4. The junctions between the upper and lower seam portions exist on imaginary lines 15*a*, 15*b* which project vertically downwards (as viewed in FIG. 1) from the lateral edges of the opening 4. As will be clear from the following description, the imaginary lines 15*a*, 15*b* substantially define the transverse extent of the projecting portion of a moulded plastics member arranged to be held between the front and back sheets 1*a*, 1*b*.

A further seam 6 extends transversely across the back sheet 1*b* and is substantially co-linear with the lower (or outer) portions 5*a*', 5*b*' of the perforated seams 5*a*, 5*b* provided in the front sheet 1*a*, when the sheets are folded on top of one another. As with the bisecting seam 2, the transverse seam 6 is provided by a cut or score extending part-way through the cardboard from the front of the cardboard (as viewed in FIG. 1).

FIG. 2 shows a transparent plastics insert 7 which is moulded from a single flat sheet of plastic. The insert has a step-wise construction with a flat rectangular peripheral edge region 8, a first raised rectangular portion 9, and a second raised rectangular portion 10. The upper portion of the flat edge region 8 is 'stepped-in' at both sides to provide a pair of shoulders 8*a*, 8*b* and a top piece 8*c*. An aperture 13 is provided through the top piece 8*c*.

Figure 3:
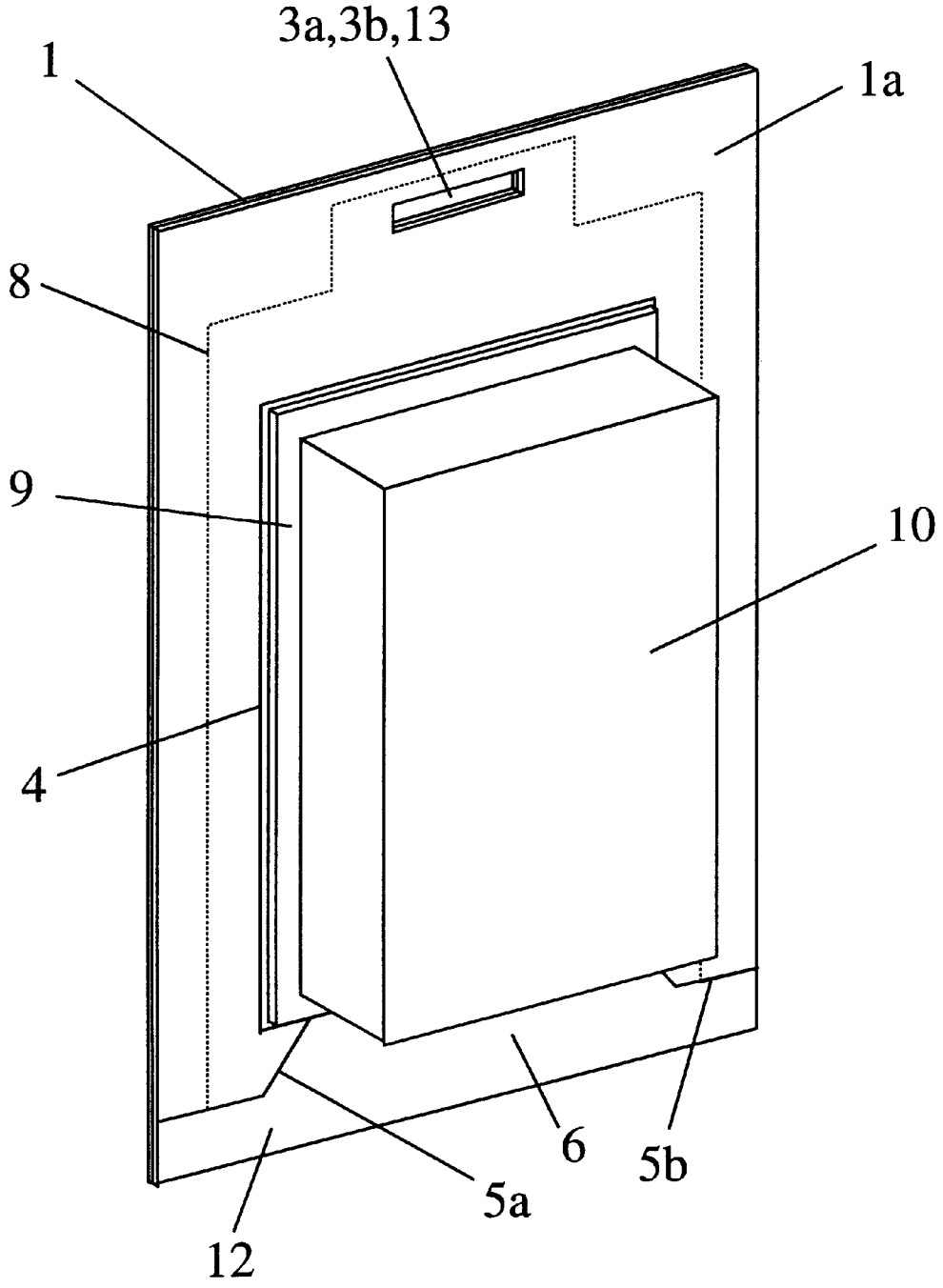
FIG. 3 shows a perspective view of a package assembled from the cardboard sheet of FIG. 1 and the plastics insert of FIG. 2.

The dimensions of the plastics insert 7 are such that, when the insert 7 is placed centrally over the back cardboard sheet 1*b*, the front cardboard sheet 1*a*can be folded about the seam 2 to cover the peripheral edge region 8 of the insert 7 whilst allowing the first and second raised portions 9 and 10 to project through the window 4. In this configuration, the three apertures 3*a*, 3*b*, and 13 are aligned with one another and the package may be suspended from a display rack by way of the apertures 3*a*, 3*b*, 13. The assembled package is shown in FIG. 3 (where the transparent insert 7 is shown opaque for the sake of clarity). The side walls of the first raised portion 9 of the plastics insert prevent the insert from moving to any great extent within the window 4 when the front sheet 1*a* is folded over.

It will be appreciated that an article to be packaged can be placed within the second raised portion 10 during assembly of the package and will thereafter be visible through the front of the insert 7. It will also be appreciated that the second raised portion 10 may be moulded to the shape of the article so that the article is held securely within the package. The package is secured by painting an adhesive along inner edge regions of one or both of the front and back sheets 1*a* and 1*b*. As shown in FIG. 1 by the shaded region 11, it is normally sufficient to provide adhesive along only the bottom and outer side edges of the back sheet 1*b*. However, as will be appreciated from the description of the package opening procedure given below, adhesive is only applied to the back layer 1*b* below the seam 6.

Figure 4:
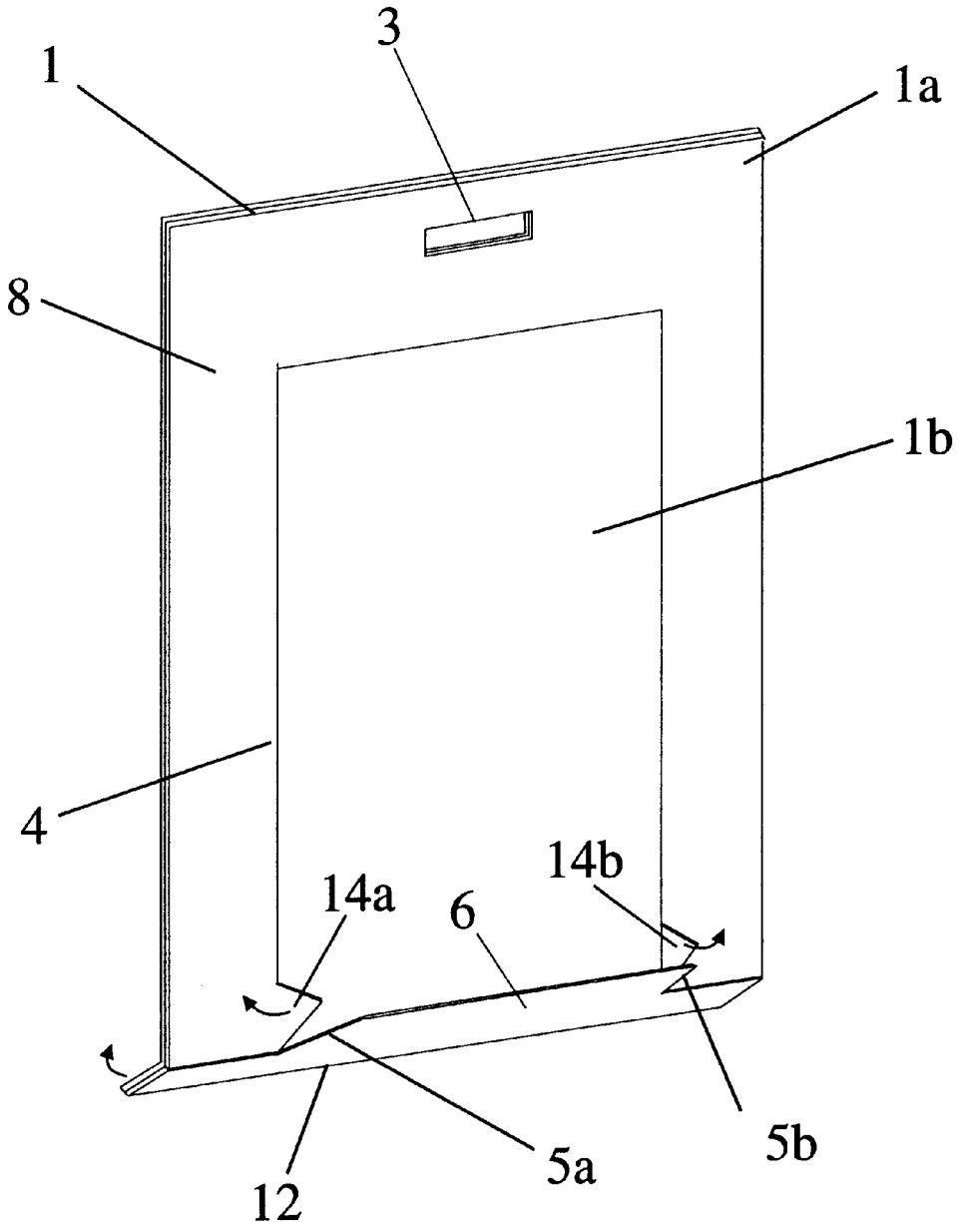
FIG. 4 shows a perspective view of the package of FIG. 3 with seams of the package opened to allow removal of the plastics insert.

In order to enable the plastics insert 7, and consequently the packaged article, to be released from between the front and back cardboard sheets 1*a*,1*b*, the bottoms of the two sheets are bent about the transverse axis defined by the seam 6 in the back cardboard sheet 1*b*. The provision of the weakened seam 6 facilities this bending action which causes the perforated seams 5*a* and 5*b* in the front sheet 1*a* to break open, effectively creating a flap 12 between the lower edge of the opening 4, the seams 5*a*, 5*b* and the lower edges of the front and back sheets 1*a*, 1*b*. When the flap 12 has been rotated so that the rear surface of the flap 12 lies flat against the rear surface of the back sheet 1*b*, the opening 4 becomes open at its lower edge. However, before the plastics insert 7 can be slid smoothly out of this open end of the opening 4, the two triangular flaps 14*a*, 14*b*, which are defined between the seams 5*a*, 5*b* and the lower edge of the opening 4, must be bent outwardly. FIG. 4 shows the packaging with the perforated seams 5*a* and 5*b* broken, the flaps 14*a*, 14*b* bent outwardly, and the plastics insert 7 removed.

From the foregoing description, it will be apparent that in order to release the plastics insert and the article it is necessary to break the perforated seams 5*a* and 5*b*. Thus, it will be readily apparent from a quick visual inspection whether or not the packaging has been opened. This will provide a significant deterrent against reuse of the package for packaging fake articles. However, it will also be appreciated that the package may be reused for legitimate purposes by merely opening the flaps 12, 14*a*, and 14*b*, and reinserting the plastics insert into the window 4.

It will be appreciated that modifications may be made to the above described embodiment without departing from the scope of the present invention. For example, in order to facilitate bending of the flaps 14*a*, 14*b*, a seam may be provided on each side of the front sheet 1*a*, the seams being located along the imaginary lines 15*a*, 15*b* shown in FIG. 1. These seams need only run from respective lower corners of the opening 4 to the seam 6 and may be provided by, for example, half-cuts on the inside of the front sheet 1*a* or by perforations. However, the seams should be strong enough not to tear when the flap 12 is folded to open the seams 5*a*, 5*b*.

For example, the bottom of the packaging may be provided with a transversely extending tear strip, defined by a pair of parallel and transverse perforated seams, which is removed to allow the plastics insert to be removed.

We claim:

1. Packaging for an article or set of articles, the packaging comprising:

a back sheet;

a front sheet having an opening in a central region thereof and being attached to the back sheet at peripheral regions of the front sheet, the front sheet being unattached to the back sheet at least in the region surrounding said opening:

a plastic member having a substantially flat peripheral edge region held between the unattached regions of the front and back sheets surrounding said openings and a control portion projecting through said opening, wherein the article(s) to be packaged can be contained between the back sheet and said central portion of the plastic member and comprising at least two breakable seams extending across said unattached regions, which seams can be broken by bending the front and back sheets in the region of the seams to enable the plastic member to be removed; and respective aligned apertures in the back sheet, the front sheet, and said peripheral edge region of the plastic member, whereby the packaging can be hung from a display rack by inserting the rack through the apertures.

2. Packaging according to claim 1, wherein said front and back sheets are of cardboard.

3. Packaging according to claim 1, wherein said seams are provided at a first side region of the packaging and said apertures are provided at a second side region, opposed to said first side region.

4. Packaging according to claim 1, and comprising a folding seam extending across the back sheet, the folding seam providing an axis about which the front and back sheets may be bent to break the breakable seams.

5. Packaging according to claim 4, wherein said folding seam is provided by a half-cut through the back sheet.

6. Packaging according to claim 5, wherein the breakable seams intersect the folding seam in the back sheet, at an angle thereto, inwardly to the opening in the front sheet.

7. Packaging for an article or set of articles, the packaging comprising:

a back sheet;

a front sheet having an opening in a central region thereof and being attached to the back sheet at peripheral regions of the front sheet, the front sheet being unattached to the back sheet at least in the region surrounding said opening;

a plastic member having a substantially flat peripheral edge region held between the unattached regions of the front and back sheets surrounding said opening, and a central portion projecting through said opening, wherein the article(s) to be packaged can be contained between the back sheet and said central portion of the plastic member; and at least two breakable seams extending across said unattached regions, which seams can be broken by bending the front and back sheets in the region of the seams to define a pair of flaps which must be bent back to enable the plastic member to be removed by sliding the plastic member in a longitudinal direction, the breakable seams lying substantially within the area of the width of the central portion of the plastic member.

8. Packaging according to claim 7, and comprising a folding seam extending across the back sheet, the folding seam defining an axis about which the front and back sheets may be bent to break the breakable seams.

9. Packaging according to claim 8, wherein the breakable seams intersect the folding seam in the back sheet, at an angle thereto, inwardly to the opening in the front sheet.

10. Packaging according to claim 9, wherein the front and back sheets are substantially rectangular and the folding seam extends transversely across the back sheet, a further pair of folding seams extending from respective outer edges of the front sheet, substantially coextensive with the folding seam in the back sheet, to respective ones of the breakable seams.

11. Packaging according to claim 7, wherein said breakable seams are provided by perforations in the front sheet.

* * * * *